US011500312B2

(12) United States Patent
Miyake et al.

(10) Patent No.: US 11,500,312 B2
(45) Date of Patent: Nov. 15, 2022

(54) IMAGING SYSTEM WITH RESISTANCE MEASUREMENT OF PRINT MEDIUM

(71) Applicant: Hewlett-Packard Development Company, L.P., Spring, TX (US)

(72) Inventors: Koji Miyake, Yokohama (JP); Shun Ikeura, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/312,150

(22) PCT Filed: Aug. 26, 2020

(86) PCT No.: PCT/US2020/047885

§ 371 (c)(1),
(2) Date: Jun. 9, 2021

(87) PCT Pub. No.: WO2021/045940

PCT Pub. Date: Mar. 11, 2021

(65) Prior Publication Data

US 2022/0187743 A1 Jun. 16, 2022

(30) Foreign Application Priority Data

Sep. 3, 2019 (JP) ..... JP2019-160435

(51) Int. Cl.
*G03G 15/00* (2006.01)
*G03G 15/16* (2006.01)

(52) U.S. Cl.
CPC ..... *G03G 15/1675* (2013.01)

(58) Field of Classification Search
CPC ..... G03G 15/1645; G03G 15/1675
USPC ..... 399/45, 66, 313, 314
See application file for complete search history.

(56) References Cited

U.S. PATENT DOCUMENTS

| | | | | |
|---|---|---|---|---|
| 5,455,664 | A | 10/1995 | Ito et al. | |
| 6,014,158 | A | 1/2000 | Ziegelmuller et al. | |
| 6,070,048 | A | 5/2000 | Nonaka et al. | |
| 7,039,334 | B2 * | 5/2006 | Deguchi | G03G 15/1675 399/45 |
| 7,742,712 | B2 * | 6/2010 | Izumi | G03G 15/6591 399/45 |

(Continued)

FOREIGN PATENT DOCUMENTS

| | | |
|---|---|---|
| JP | 2013114226 A | 6/2013 |
| JP | 2014062977 A | 4/2014 |

(Continued)

*Primary Examiner* — William J Royer
(74) *Attorney, Agent, or Firm* — Trop Pruner & Hu, P.C.

(57) ABSTRACT

An imaging system includes a transfer roller having a surface to transfer a toner image onto a print medium during a printing operation of the imaging system, a conductive device to contact the surface of the transfer roller, a power source electrically connected to the conductive device, a resistance measurement device, and a controller. The transfer roller rotates according to a printing speed of the printing operation. The power source supplies a bias to the transfer roller through the conductive device during the printing operation. The resistance measurement device measures an electrical resistance of the print medium. The controller reduces the printing speed based on the electrical resistance measured by the resistance measurement device.

20 Claims, 12 Drawing Sheets

(56) References Cited

U.S. PATENT DOCUMENTS

| | | | | |
|---|---|---|---|---|
| 7,802,791 | B2 * | 9/2010 | Yoshizawa et al. | B65H 5/34 271/265.01 |
| 8,843,039 | B2 * | 9/2014 | Namba | G03G 15/162 399/313 |
| 9,158,242 | B2 | 10/2015 | Saito | |
| 10,338,490 | B1 * | 7/2019 | Stafford et al. | G03G 15/0189 |
| 10,955,773 | B2 * | 3/2021 | Yamaura et al. | G03G 15/5029 |
| 11,009,815 | B2 * | 5/2021 | Matsuzaki et al. | G03G 15/161 |
| 2003/0072578 | A1 | 4/2003 | Boothe et al. | |
| 2017/0205754 | A1 * | 7/2017 | Tabata | G03G 15/1605 |

FOREIGN PATENT DOCUMENTS

| | | | |
|---|---|---|---|
| JP | 2014089387 | A | 5/2014 |
| JP | 2018146892 | A | 9/2018 |

* cited by examiner

IMAGING SYSTEM WITH RESISTANCE MEASUREMENT OF PRINT MEDIUM

BACKGROUND

An imaging apparatus includes a transfer unit for transferring a toner image onto a print medium. The transfer unit includes a transfer belt carrying the toner image, a transfer roller being in contact with the transfer belt, a power feed roller for supplying a bias to be transferred to the transfer roller. The transfer roller is provided with a shaft functioning as a conductive shaft core. The transfer roller includes an ion conductive material of an epichlorohydrin rubber or the like. The transfer belt is connected to ground, and the power feed roller is connected to a power source. The bias to be transferred from the power source is supplied to the shaft of the transfer roller through the power feed roller is provided.

DETAILED DESCRIPTION

In the following description, with reference to the drawings, the same reference numbers are assigned to the same components or to similar components having the same function, and overlapping description is omitted.

An example imaging system will be described. An imaging system may include an imaging apparatus such as a printer, or the like according to some examples, or a device or system within an imaging apparatus according to other examples.

Figure 1:
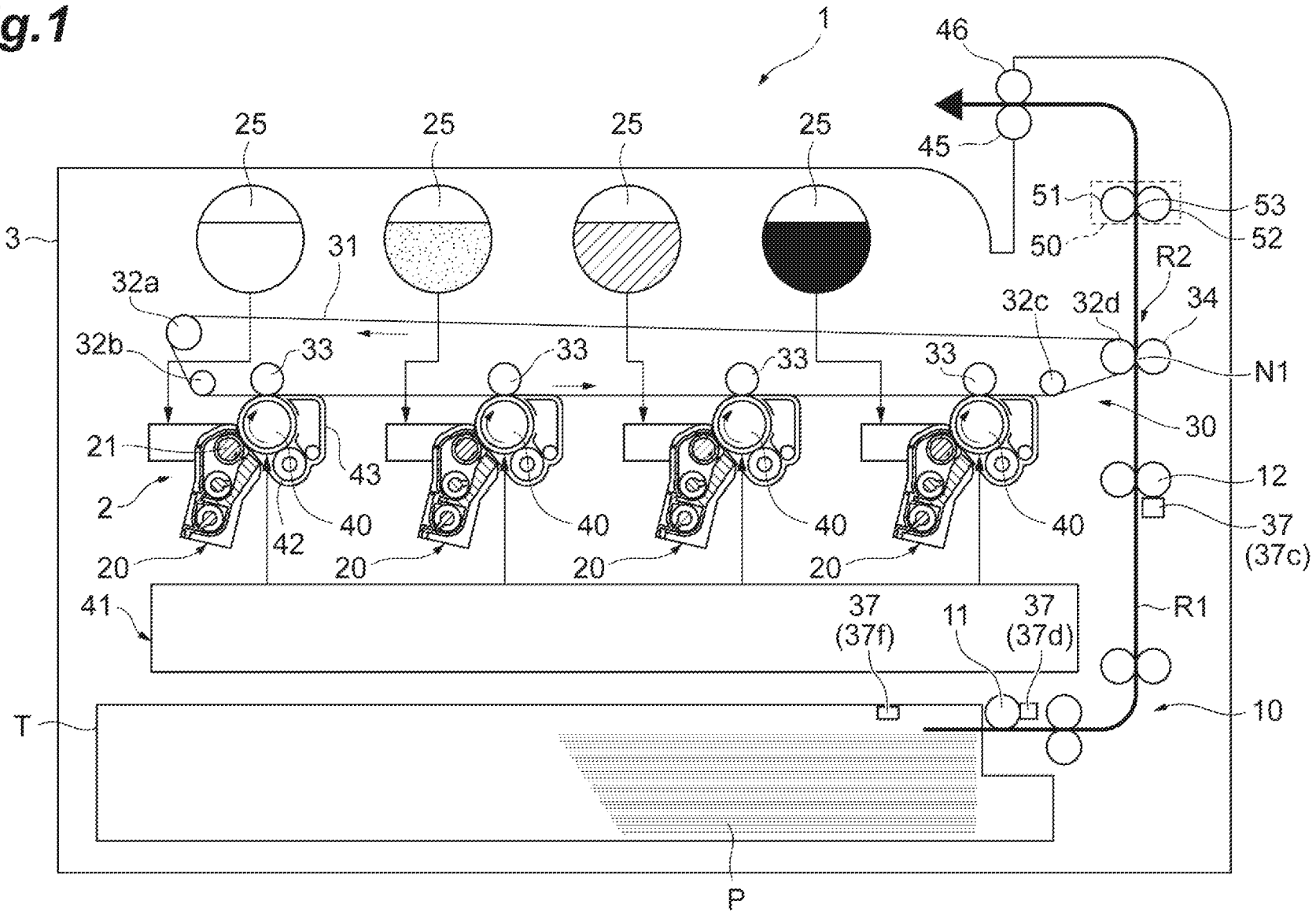
FIG. 1 is a schematic view of an imaging apparatus including an example transfer device.

With reference to FIG. 1, an example imaging apparatus 1 may form a color image by using the colors of magenta, yellow, cyan, and black. The imaging apparatus 1 includes, for example, a recording medium transporting device 10, a plurality of developing devices 20, a transfer unit (or transfer device) 30, a plurality of photoreceptors 40, and a fixing device 50. The recording medium transporting device 10 transports a print medium P. The print medium P may include a sheet such as a sheet of paper. The photoreceptor 40 forms an electrostatic latent image, and the developing device 20 develops the electrostatic latent image, to form a toner image. The transfer unit (or device) 30 secondarily transfers the toner image onto the print medium P. In some examples, the fixing device 50 may fix the toner image on the print medium P.

In some examples, the recording medium transporting device 10 includes a pick-up roller 11 for transporting the print medium P on which an image is to be formed, along a transporting path R1 and registration rollers 12 provided on the downstream side of the pick-up roller 11 in the transporting path R1. The print medium P that is stacked and stored in a tray T is picked up by the pick-up roller 11 to be transported. The pick-up roller 11 is provided, for example, near the exit of the print medium P of the tray T.

The registration rollers 12 transport the print medium P picked up by the pick-up roller 11. A secondary transfer region R2 in which the toner image is transferred onto the print medium P is provided on the downstream side of the registration rollers 12 in the transporting path R1 of the print medium P. The registration rollers 12 are located on the upstream side of the secondary transfer region R2 (transfer roller 34) in the transporting path R1 of the print medium P. The registration rollers 12 direct the print medium P to reach the secondary transfer region R2 through the transporting path R1 at the timing when the toner image to be transferred onto the print medium P, reaches the secondary transfer region R2.

In some examples, one developing device 20 is provided for each color. Each developing device 20 includes a developing roller 21 to transfer toner to the photoreceptor 40. The toner is carried on the developing roller in the form of a developer that includes toner particles and carrier particles. The toner and the carrier are adjusted to have a predetermined or targeted mixing ratio, and the toner and the carrier are mixed and stirred such that the toner is uniformly dispersed in the developer. The developer is carried on the developing roller 21. The developing roller 21 is rotated to transport the developer to a region facing the photoreceptor 40. Then, the toner in the developer that is carried on the developing roller 21, is moved or transferred to the electrostatic latent image on the photoreceptor 40, and accordingly, the electrostatic latent image is developed.

In some examples, transfer unit (transfer device) 30 transports the toner image formed by the developing device 20 and the photoreceptor 40, to the secondary transfer region R2. In some examples the toner image transferred or transported may include the image developed to the photoreceptor 40. As an example, the transfer unit 30 includes a transfer belt 31, suspension rollers 32*a*, 32*b*, and 32*c*, a drive roller 32*d*, a transfer roller 33 which is a primary transfer roller, and the transfer roller 34 which is a secondary transfer roller. The transfer roller 34 transfers the toner image onto the print medium P during the printing operation of the imaging apparatus 1 and is rotated according to a printing speed of the printing. The transfer belt 31 may be suspended or supported by the suspension rollers 32*a*, 32*b*, and 32*c* and the drive roller 32*d*. The drive roller 32*d* is a backup roller for suspending or supporting the transfer belt 31 together with the suspension rollers 32*a*, 32*b*, and 32*c*. One transfer roller 33 may be provided for each color. Each transfer roller 33 is associated with one photoreceptor 40 and the transfer belt 31 is interposed between the transfer roller 33 and the photoreceptor 40. The transfer belt 31 is interposed between transfer roller 34 together with the drive roller 32*d*.

In some examples, the transfer belt 31 is an endless belt that is circularly moved by the suspension rollers 32*a*, 32*b*, and 32*c* and the drive roller 32*d*. The transfer belt 31 is pressed by the transfer roller 33 against the photoreceptor 40 from the inner peripheral side of the transfer belt 31. At the secondary transfer region R2, the transfer belt 31 and the drive roller 32*d* may be located on an opposite side of the secondary transfer region R2, relative to the transfer roller 34. Accordingly, the transfer belt 31 and the drive roller 32*d* are located, for example, on an opposite side of the transfer roller 34 when viewed from the print medium P. The drive roller 32*d* presses the transfer roller 34 from the inner peripheral side of the transfer belt 31.

In some examples, the photoreceptor 40 is a photosensitive drum and photoreceptor 40 is provided for each color. The plurality of photoreceptors 40 are spaced apart along the moving direction of the transfer belt 31. One developing device 20, an exposure unit (exposure device) 41, a charging device 42, and a cleaning device 43 are located adjacent each photoreceptor 40, so as to be provided at the facing position of the outer peripheral surface of each photoreceptor 40.

The imaging apparatus 1 as an example includes a process cartridge 2 including the developing device 20, the photoreceptor 40, the charging device 42, and the cleaning device 43 as an integral part, and a housing 3 from which the process cartridge 2 is detachable. By opening a door of the housing 3 and inserting or removing the process cartridge 2 with respect to the housing 3, the process cartridge 2 is detachable from the housing 3.

In some examples, the charging device 42 uniformly charges the outer peripheral surface of the photoreceptor 40 to a predetermined potential. The charging device 42 may include, for example, a charging roller which rotates following the rotation of the photoreceptor 40. The exposure unit 41 exposes the outer peripheral surface of the photoreceptor 40 charged by the charging device 42 to a light, according to the image to be formed on the print medium P. The potential of the portions of the outer peripheral surface of the photoreceptor 40 that are exposed to the exposure unit (or device) 41, is changed, so that the electrostatic latent image is formed on the outer peripheral surface of the photoreceptor 40.

According to examples, each of the plurality of developing devices 20 is arranged to face or to align with a toner tank 25. Each toner tank 25 stores toner of a color, for example, magenta, yellow, cyan, and black. Toner is supplied from each toner tank 25 to the respective developing device 20. Each developing device 20 forms a toner image on the outer peripheral surface of the associated photoreceptor 40 by developing the electrostatic latent image with the supplied toner. The toner image formed on the outer peripheral surface of the photoreceptor 40 is primarily transferred to the transfer belt 31, and toner remaining on the outer peripheral surface of the photoreceptor 40 after the primary transfer, is removed by the cleaning device 43.

In some examples, the fixing device 50 fixes the toner image secondarily transferred onto the print medium P from the transfer belt 31. The fixing device 50 includes, as an example, a heating roller 51 for fixing the toner image on the print medium P while heating the print medium P and a pressing roller 52 for pressing the heating roller 51. Both the heating roller 51 and the pressing roller 52 are formed, for example, in a cylindrical shape.

As an example, a heat source such as a halogen lamp is provided inside the heating roller 51. In some examples, a heat source such as a halogen lamp may be provided inside the pressing roller 52. A fixing nip portion 53 as a fixing area of the print medium P is provided between the heating roller 51 and the pressing roller 52. The print medium P passes through the fixing nip portion 53, so that the toner image is fused and fixed on the print medium P.

An example printing process carried out by the example imaging apparatus 1 will be described. For example, when the print signal of the image to be recorded is input to the imaging apparatus 1, the print medium P stacked in the tray T is picked up through the rotation of the pick-up roller 11, and the print medium P is transported along the transporting path R1. The charging device 42 uniformly charges the outer peripheral surface of the photoreceptor 40 to a predetermined potential based on the print signal. The exposure unit 41 forms the electrostatic latent image on the outer peripheral surface of the photoreceptor 40 by irradiating the outer peripheral surface of the photoreceptor 40 with a laser beam.

The developing device 20 may perform developing by forming the toner image on the photoreceptor 40. In some examples, the toner image is primarily transferred to the transfer belt 31 from each photoreceptor 40. The photoreceptors 40 transfer the respective toner images at respective regions of the transfer belt 31, where each photoreceptor 40 faces the transfer belt 31. For example, the toner images formed on the plurality of photoreceptors 40 are sequentially layered or superimposed on the transfer belt 31, so that a single composite toner image is formed. The composite toner image is secondarily transferred onto the print medium P transported from the recording medium transporting device 10 at the secondary transfer region R2 having a first nip portion N1 where the drive roller 32*d* and the transfer roller 34 face each other.

The print medium P to which the composite toner image is secondarily transferred is transported from the secondary transfer region R2 to the fixing device 50. The fixing device 50 fuses and fixes the composite toner image on the print medium P, for example, by applying heat and pressure to the print medium P passing through the fixing nip portion 53. The print medium P passing through the fixing nip portion 53 of the fixing device 50 is discharged to the outside of the imaging apparatus 1, for example, by discharge rollers 45 and 46.

An example transfer unit (transfer device) 30 will be described.

Figure 2:
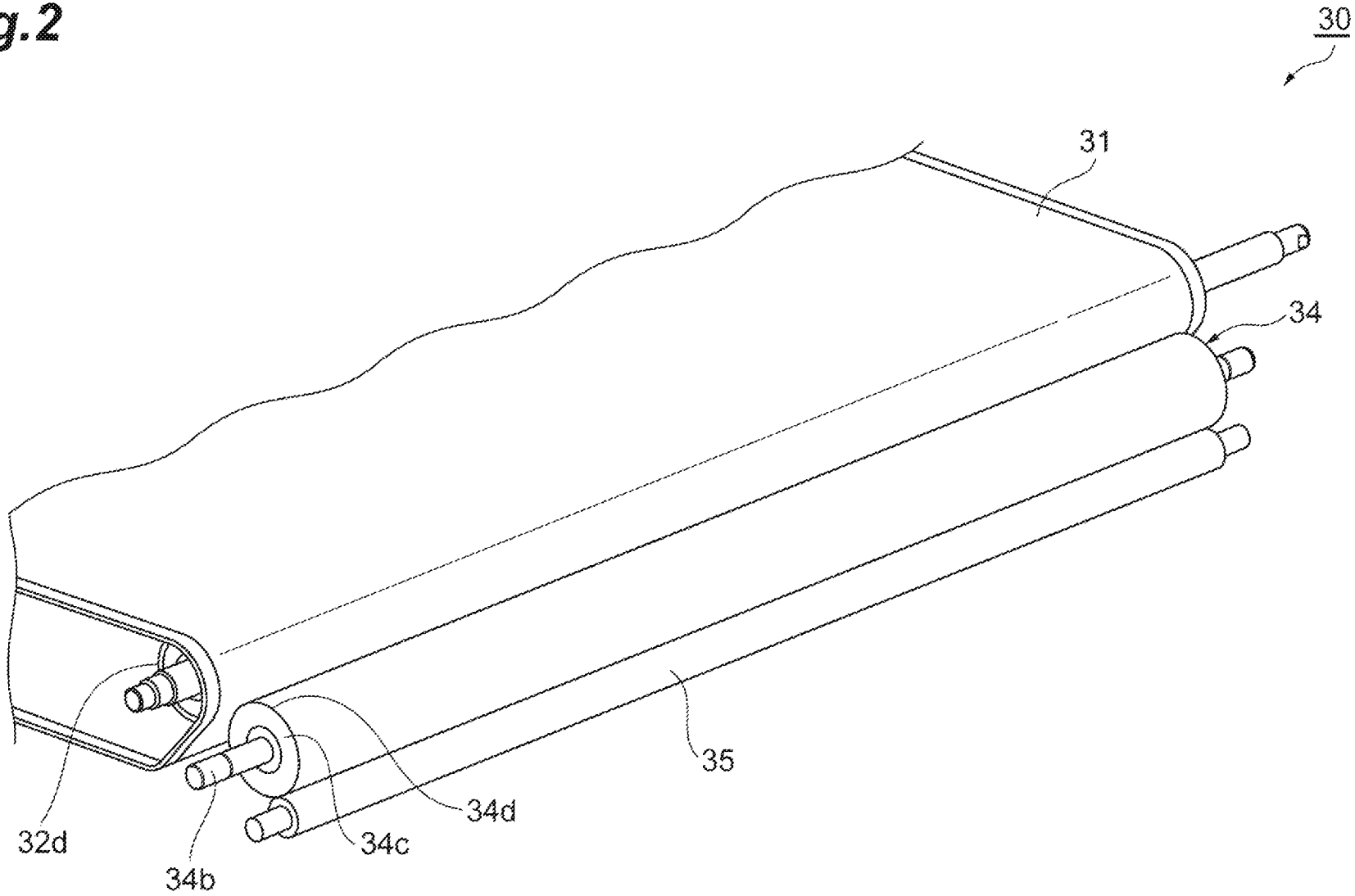
FIG. 2 is a partial perspective view of the example transfer device illustrated in FIG. 1.
Figure 3:
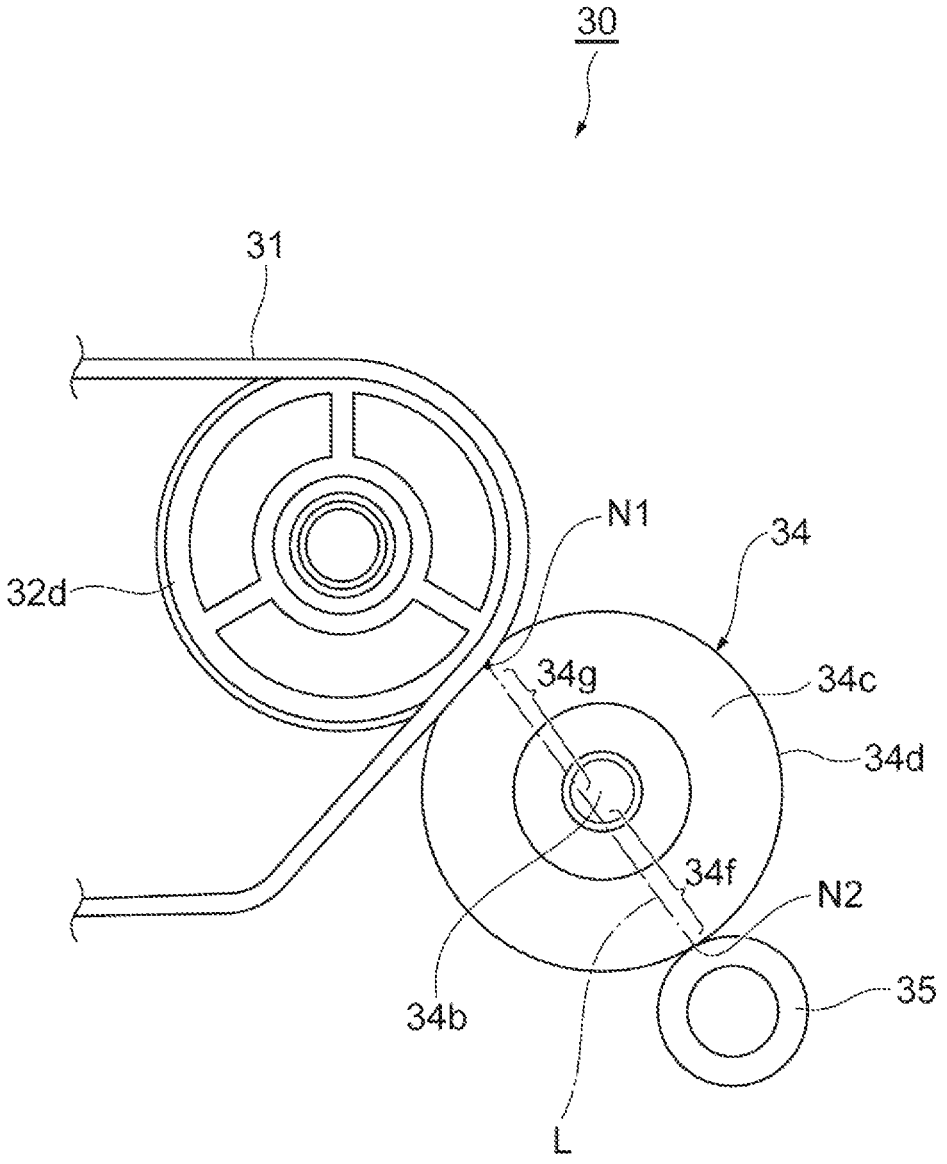
FIG. 3 is a partial side view of the example transfer device illustrated in FIG. 1.

With reference to FIGS. 2 and 3, the transfer roller 34 of the transfer unit (or device) 30 includes, for example, a shaft 34*b*, and a foam layer 34*c* covering the shaft 34*b*. The foam layer 34*c* is configured with, for example, closed cells or open cells. The shaft 34*b* is made of a metal and the foam layer 34*c* is made of a material having a high flexibility. The foam layer 34*c* is, for example, in a sponge state. The transfer roller 34 has a surface 34*d* for transferring the toner image onto the print medium P. The surface 34*d* of the transfer roller 34 is configured with foam, and a large number of micropores are formed in the surface 34*d* of the foam layer 34*c*.

The shaft 34*b* may be a metal shaft which is electrically floated (or floating) during the printing operation. The phrase "electrically floated" or "electrically floating" denotes, for example, a state in which the electrical potential in the metal shaft is electrically isolated. The first nip portion N1 is formed between the transfer roller 34 and the transfer belt 31, and thus, when the print medium P passes through the first nip portion N1, the toner image is transferred from the transfer belt 31 onto the print medium P. The transfer roller 34 contains an ion conductive agent.

The transfer unit (or device) 30 includes, for example, a conductive device 35 that is in contact with the transfer roller 34. The conductive device 35 functions as a power feed member (or power supply) for supplying power to the transfer roller 34 externally or indirectly (e.g., from the outside of the transfer roller 34). The conductive device 35 has a lower electrical resistance, for example, than the transfer roller 34.

The conductive device 35 may be, for example, a conductive roller. A second nip portion N2 may be formed between the conductive device 35 and the transfer roller 34. The nip pressure of the second nip portion N2 may be less than the nip pressure of the first nip portion N1. The conductive device 35 may be a cleaning roller having cross-sectional shape that is a circular shape and may be driven to rotate by the transfer roller 34. The transfer roller 34 and the conductive device 35 may be arranged so that a virtual line L intersecting the first nip portion N1 and the second nip portion N2, also intersects the shaft 34*b* of the transfer roller 34.

Figure 4:
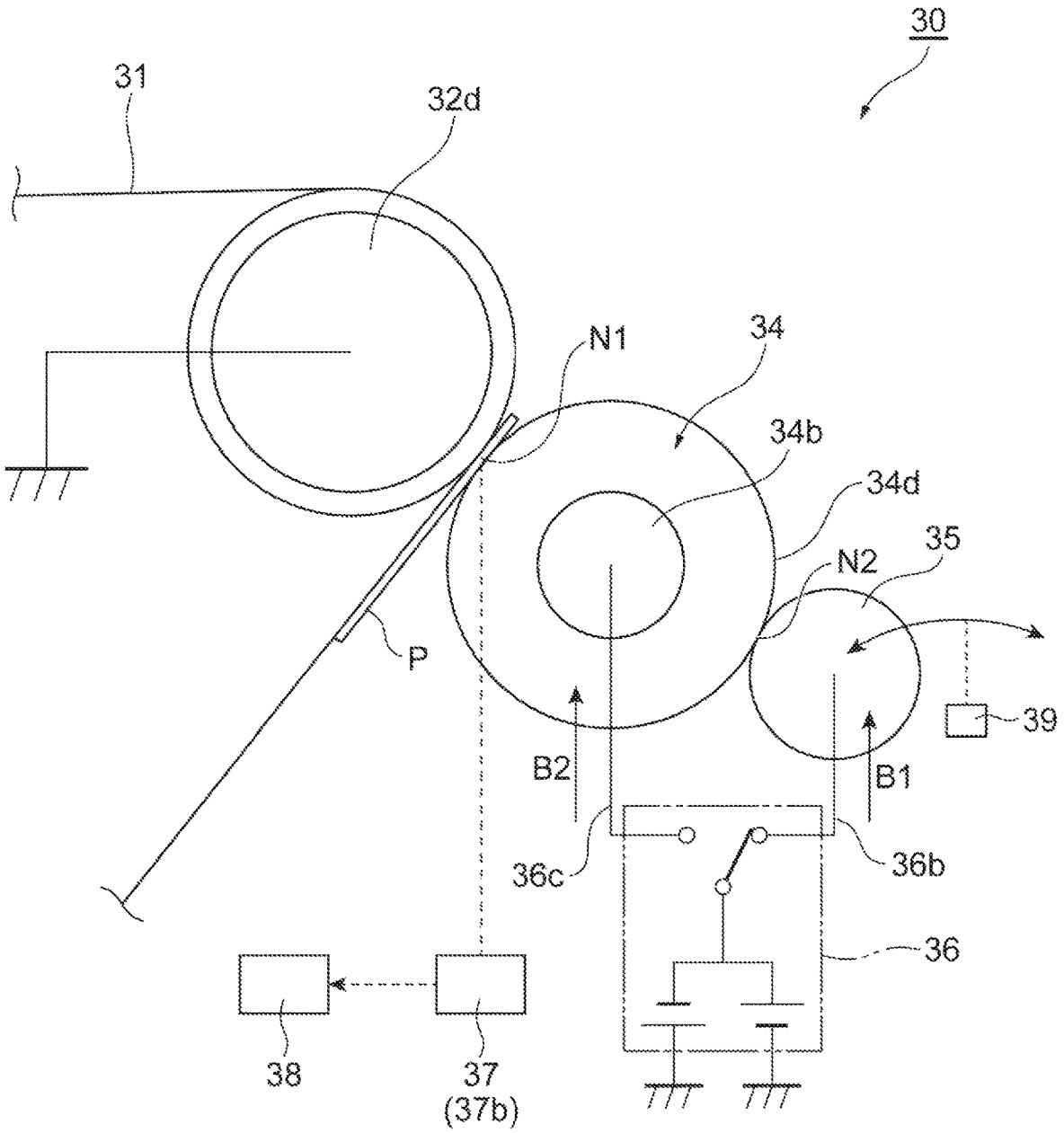
FIG. 4 is a schematic diagram of the example transfer device illustrated in FIG. 1.

FIG. 4 is a schematic side view of an example arrangement of the drive roller 32*d*, the transfer belt 31, the transfer roller 34, and the conductive device 35. With reference to FIG. 4, the drive roller 32*d* is electrically connected to the ground. The transfer unit (or device) 30 includes, for example, a power source 36 for supplying (application of a bias voltage) a first bias B1 to the conductive device 35 or supplying of a second bias B2 to the transfer roller 34.

The power source 36 is electrically connected to the ground and is electrically connected to the shaft 34*b* of the transfer roller 34 and to the conductive device 35. The power source 36 includes a first supply path 36*b* for supplying the first bias B1 to the conductive device 35, and a second supply path 36*c* for directly supplying the second bias B2 to the shaft 34*b* of the transfer roller 34.

In some examples, the power source 36 may supply the first bias B1 to the conductive device 35 during a normal printing operation and may supply the second bias B2 to the shaft 34*b* when the resistance of the transfer roller 34 is increased. The first bias B1 supplied to the conductive device 35 is supplied to the shaft 34*b* of the transfer roller 34 via the portion of the surface 34*d* of the transfer roller 34 that is in contact with the conductive device 35.

For example, in a case where the toner is negatively charged, the power source 36 supplies a positive first bias B1 to the transfer roller 34 through the conductive device 35, and by attracting the toner from the transfer belt 31 toward the transfer roller 34 and therefore toward the print medium P, the toner image is transferred onto the print medium P. Still in the case where the toner is negatively charged, the power source 36 may remove the toner adhering to the transfer roller 34, for example, by supplying a negative first bias B1 to the transfer roller 34 during the cleaning.

In some examples, the transfer unit (or device) 30 includes a resistance measurement device 37 for measuring an electrical resistance of the print medium P and a controller 38 for decelerating the print medium P based on the electrical resistance measured by the resistance measurement device 37. The resistance measurement device 37 includes a system resistance measurement device 37*b* for measuring an electrical resistance of the first nip portion N1 formed between the transfer roller 34 and the transfer belt 31. The system resistance measurement device 37*b* may be included in the power source 36. The system resistance measurement device 37*b* may measure the system resistance by a feedback voltage value corresponding to a voltage value applied from the power source 36 to the first nip portion N1. In addition, the system resistance measurement device 37*b* may measure the system resistance by a feedback current value corresponding to a current value applied from the power source 36 to the first nip portion N1.

As an example, the system resistance measurement device 37*b* may measure the system resistance of the transfer roller 34 in a state where there is no print medium P at the first nip portion N1, and measure the system resistance of the transfer roller 34 and the print medium P in a state where there is a print medium P at the first nip portion N1, and the electrical resistance of the print medium P may be calculated from these system resistances measured.

The controller 38 reduces the printing speed, for example, when the electrical resistance measured by the resistance measurement device 37 is equal to or greater than a threshold resistance value. The "threshold resistance value" is a reference value that may be suitably set for determining whether or not the measured electrical resistance of the print medium P is a value not affecting the transfer by the transfer roller 34.

The transfer unit (or device) 30 may include a contact-separation mechanism 39 to operate the conductive device 35 to be in contact with or separated from the transfer roller 34. For example, the contact separation mechanism 39 may allow the conductive device 35 to be separated from the transfer roller 34, for example by displacing the conductive device 35 away from the transfer roller 34, at the time of the supply of the second bias B2 to the transfer roller 34. The contact separation mechanism 39 may further allow the conductive device 35 to be in contact with the transfer roller 34, for example by displacing the conductive device 35 toward the transfer roller 34, at the time of the supply of the first bias B1 to the conductive device 35. By allowing the conductive device 35 to be in contact with the transfer roller 34 at the time of the supply of the first bias B1, the first bias B1 is supplied to the transfer roller 34 toward the shaft 34*b* through the surface 34*d* from the outside of the transfer roller 34.

Figure 5:
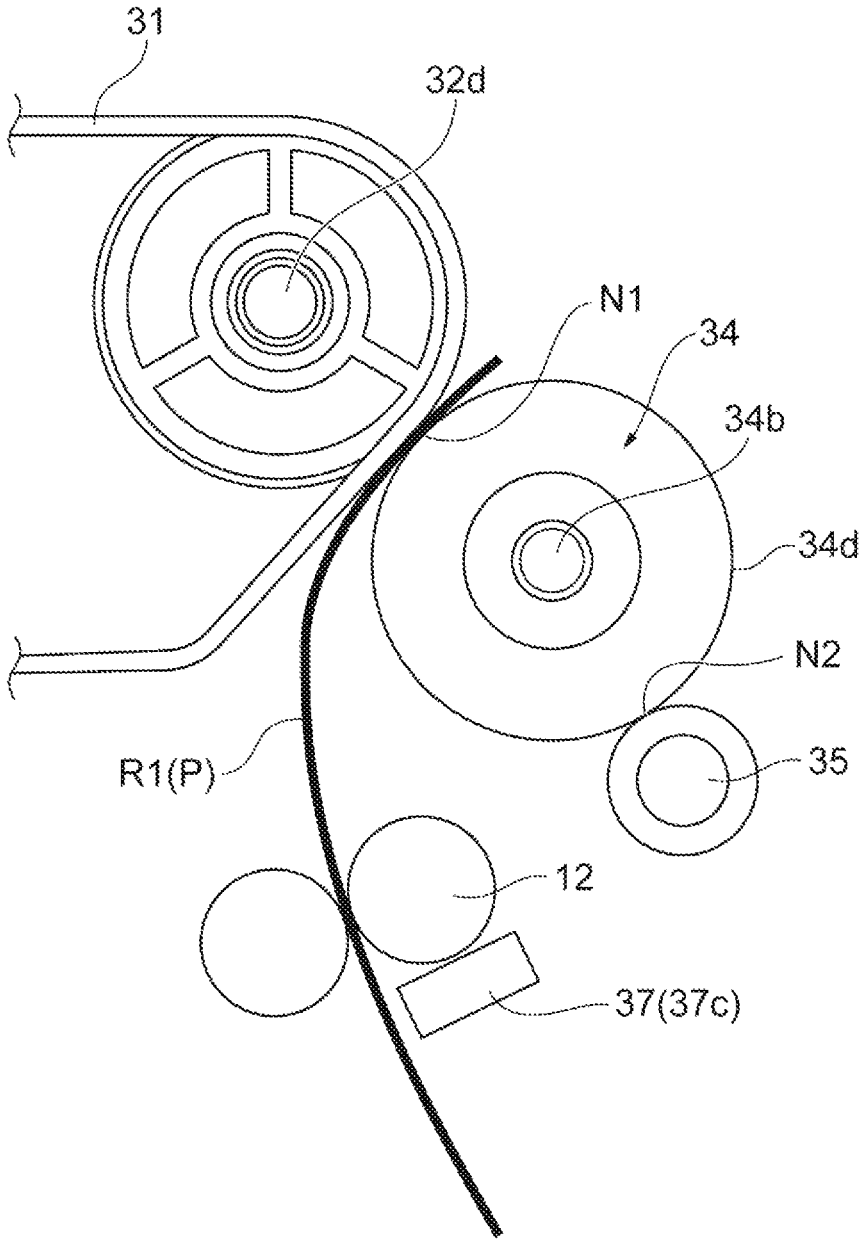
FIG. 5 is a schematic diagram of a modified example of a transfer device for the imaging apparatus illustrated in FIG. 1.

With reference to FIGS. 1 and 5, the resistance measurement device 37 may include a resistance detection sensor 37*c* arranged in or adjacent the registration rollers 12 located on the upstream side of the transfer roller 34 in the transporting path R1 of the print medium P. The resistance detection sensor 37*c* may detect the electrical resistance of the print medium P when the print medium P enters the registration rollers 12 and may detect the electrical resistance of the print medium P when the print medium P is unloaded from the registration rollers 12. As an example, the resistance detection sensor 37*c* may detect at least one of water content and thickness of the print medium P and estimate the electrical resistance of the print medium P from the detected water content or the detected thickness of the print medium P.

The resistance measurement device 37 may include a resistance detection sensor 37*d* arranged on or adjacent the pick-up roller 11 for picking up the print medium P stored in the tray T, and may include a resistance detection sensor 37*f* arranged in the tray T. Accordingly, the resistance detection sensors constituting the resistance measurement device 37 may be arranged at various locations if the locations are on the transporting path R1 from the tray T to the first nip portion N1. The arrangement locations and the number of the resistance detection sensors constituting the resistance measurement device 37 may be changed as appropriate.

Figure 6:
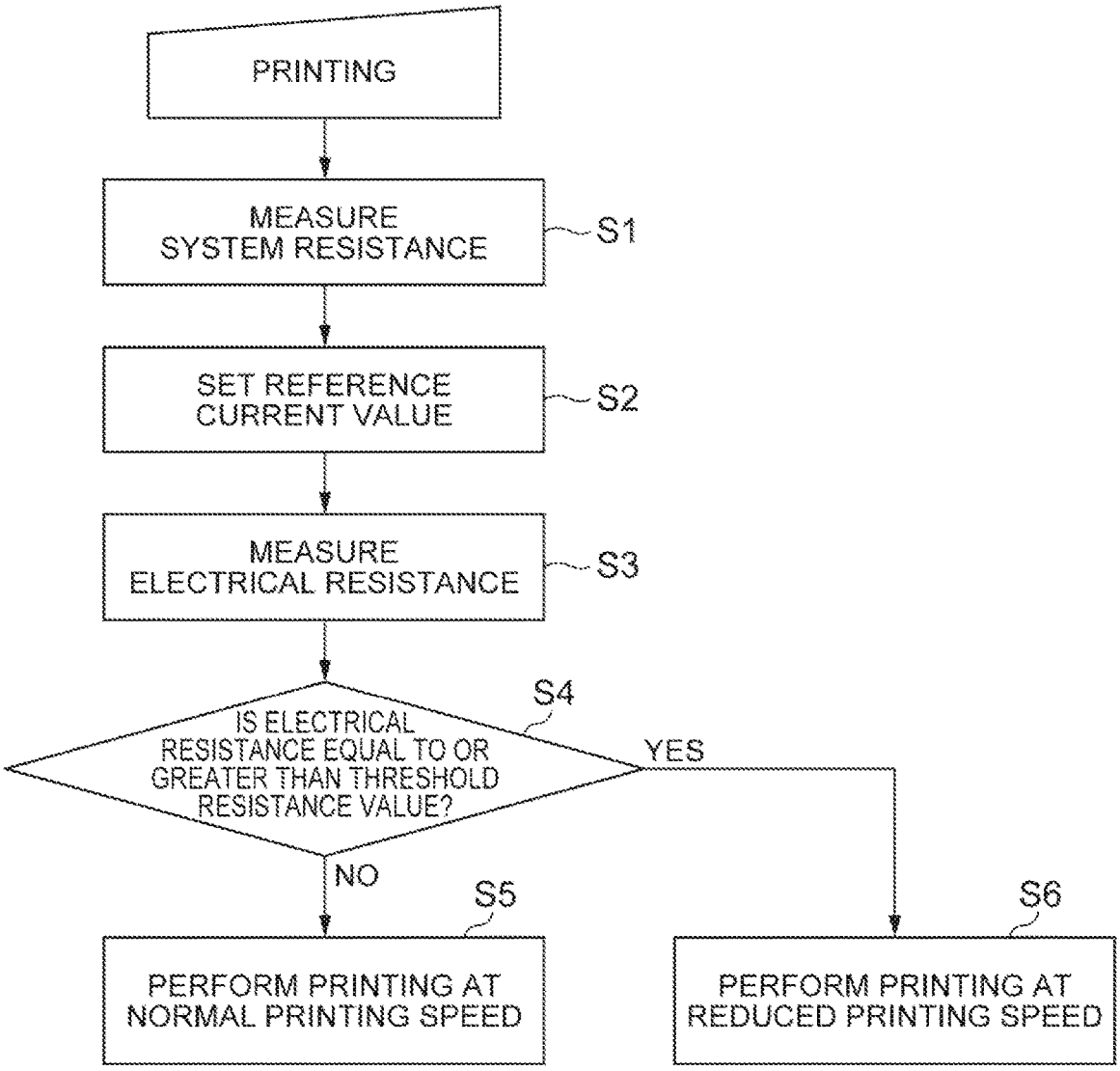
FIG. 6 is a flowchart of an example process to adjust a printing speed of an imaging system.

With reference to FIG. 6, example transfer operations carried out by the transfer unit (or device) 30 during the printing operation of the imaging apparatus 1 will be described. At operation S1, when the print signal is input to the imaging apparatus 1, the system resistance measurement device 37*b* measures the system resistance of the transfer roller 34 before passing the print medium P. At operation S2, the controller 38 sets the reference current value of the current to be supplied to the transfer roller 34. At this time, the value of the bias supplied to the transfer roller 34 may be set.

At operation S3, when the print medium P is picked up by the pick-up roller 11 from the tray T and is transported to the secondary transfer region R2 through the transporting path R1, the resistance measurement device 37 measures the electrical resistance of the print medium P which has reached the first nip portion N1. At this time, the system resistance measurement device 37*b* may measure the electrical resistance of the transfer roller 34 and the print medium P at the time of conveying the print medium P through the first nip portion N1, and the electrical resistance of the print medium P may be calculated from the electrical resistance measured and the system resistance measured at operation S1.

At operation S4, the controller 38 determines whether or not the electrical resistance of the print medium P is equal to or greater than the threshold resistance value. If it is determined by the controller 38 that the electrical resistance of the print medium P is less than the threshold resistance value (e.g., not equal to or greater than the threshold resistance value), the process proceeds to operation S5 to continue printing at a normal printing speed.

At operation S4, when it is determined by the controller 38 that the electrical resistance of the print medium P is equal to or greater than the threshold resistance value, the process proceeds to operation S6 to perform the subsequent printing at a reduced printing speed. At this time, the controller 38 may reduce the printing speed to ½ or ⅓, for example. Through the above-described process, the printing speed of the imaging apparatus 1 is adjusted at operations S5 and S6.

In the above-described example imaging apparatus 1, the transfer roller 34 includes the above-described ion conductive agent. With reference to FIGS. 3 and 4, during the printing operation (during the transferring onto the print medium P), the power source 36 supplies the first bias B1 to the transfer roller 34 from the outside through the conductive device 35. The first bias B1 supplied to the conductive device 35 is supplied to the shaft 34*b* of the transfer roller 34 from the portion (second nip portion N2) that is in contact with the conductive device 35 in the surface 34*d* of the transfer roller 34. Accordingly, the path to supply a bias voltage to the transfer roller 34 includes a first path 34*f* directed from the surface 34*d* toward the shaft 34*b* side (radially inwardly of the transfer roller 34) and a second path 34*g* directed from the shaft 34*b* toward the surface 34*d* side (radially outwardly).

The path to supply the bias voltage is formed with the first path 34*f* and the second path 34*g* in order to suppress or inhibit a phenomenon by which the ion conductive agent of the transfer roller 34 is unevenly distributed on the surface 34*d* side. As a result, with reference to FIG. 7, an increase in the electrical resistance of the transfer roller 34 may be prevented or inhibited. In a comparative example where a bias continues to be directly supplied to the shaft 34*b*, the electrical resistance of the transfer roller 34 is increased from 7.2 (log Ω) to 7.7 (log Ω) after printing 500,000 sheets, and the electrical resistance of the transfer roller 34 reaches up to 8.2 (log Ω) after printing 1,000,000 sheets.

Figure 7:
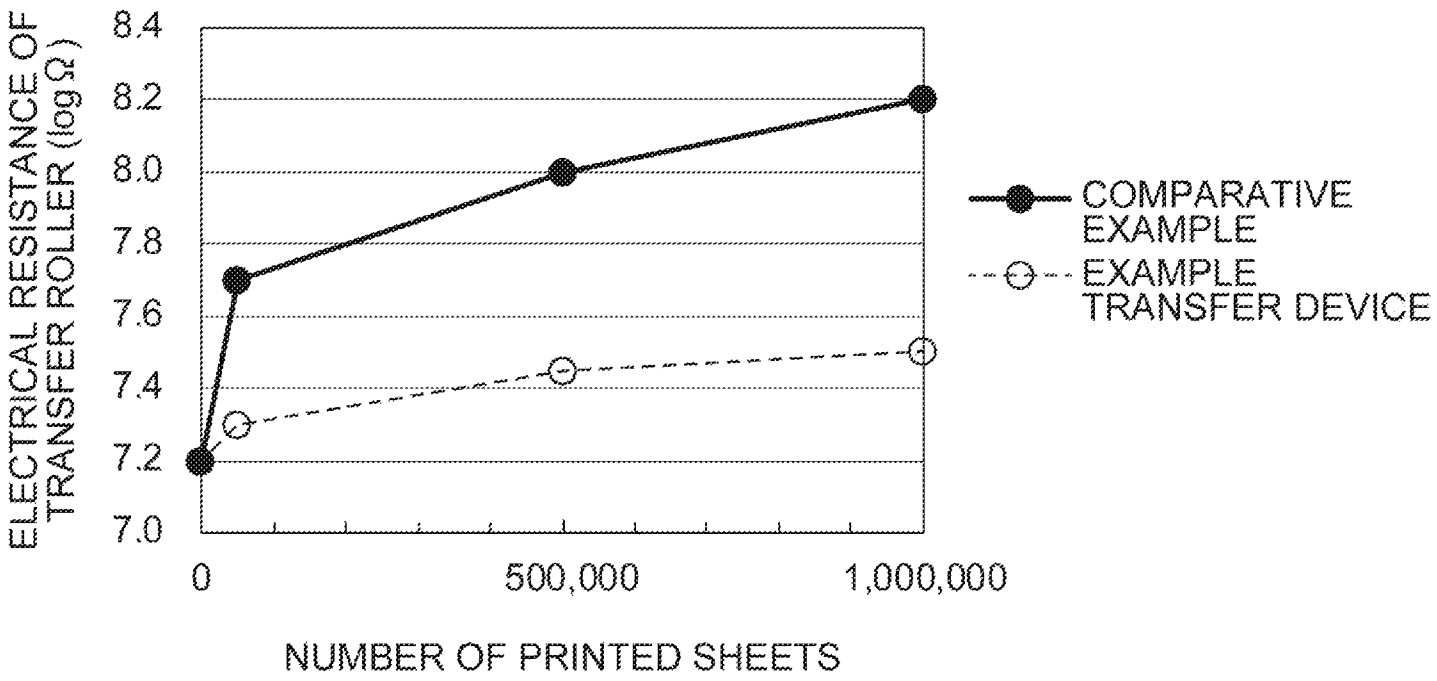
FIG. 7 is an example graph illustrating an electrical resistance of a transfer roller in relation to a number of printed sheets, for an example imaging system, and a comparative example of an imaging system.

In the above-described example where the first bias B1 is supplied to the transfer roller 34 through the conductive device 35 during the printing operation, the graph of FIG. 7 shows that the electrical resistance is increased from 7.2 (log Ω) to 7.5 (log Ω) after printing 1,000,000 sheets, and accordingly, the increase in the electrical resistance of the transfer roller 34 is reliably suppressed.

Figure 8:
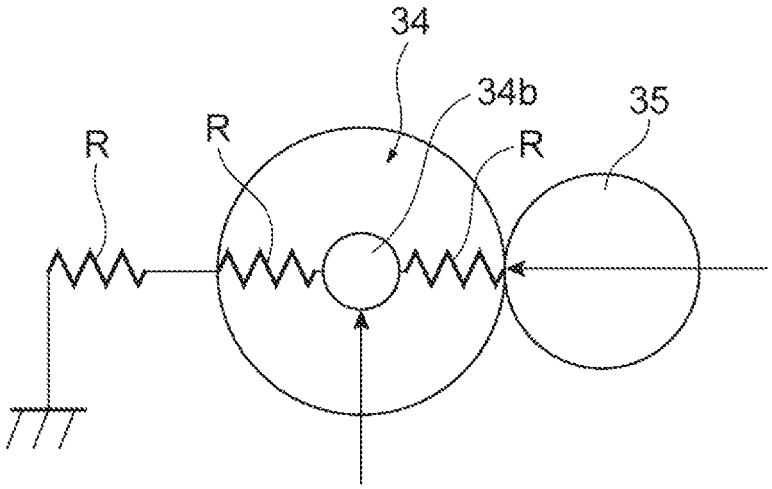
FIG. 8 is a schematic diagram illustrating a system resistance in the transfer roller.
Figure 9:
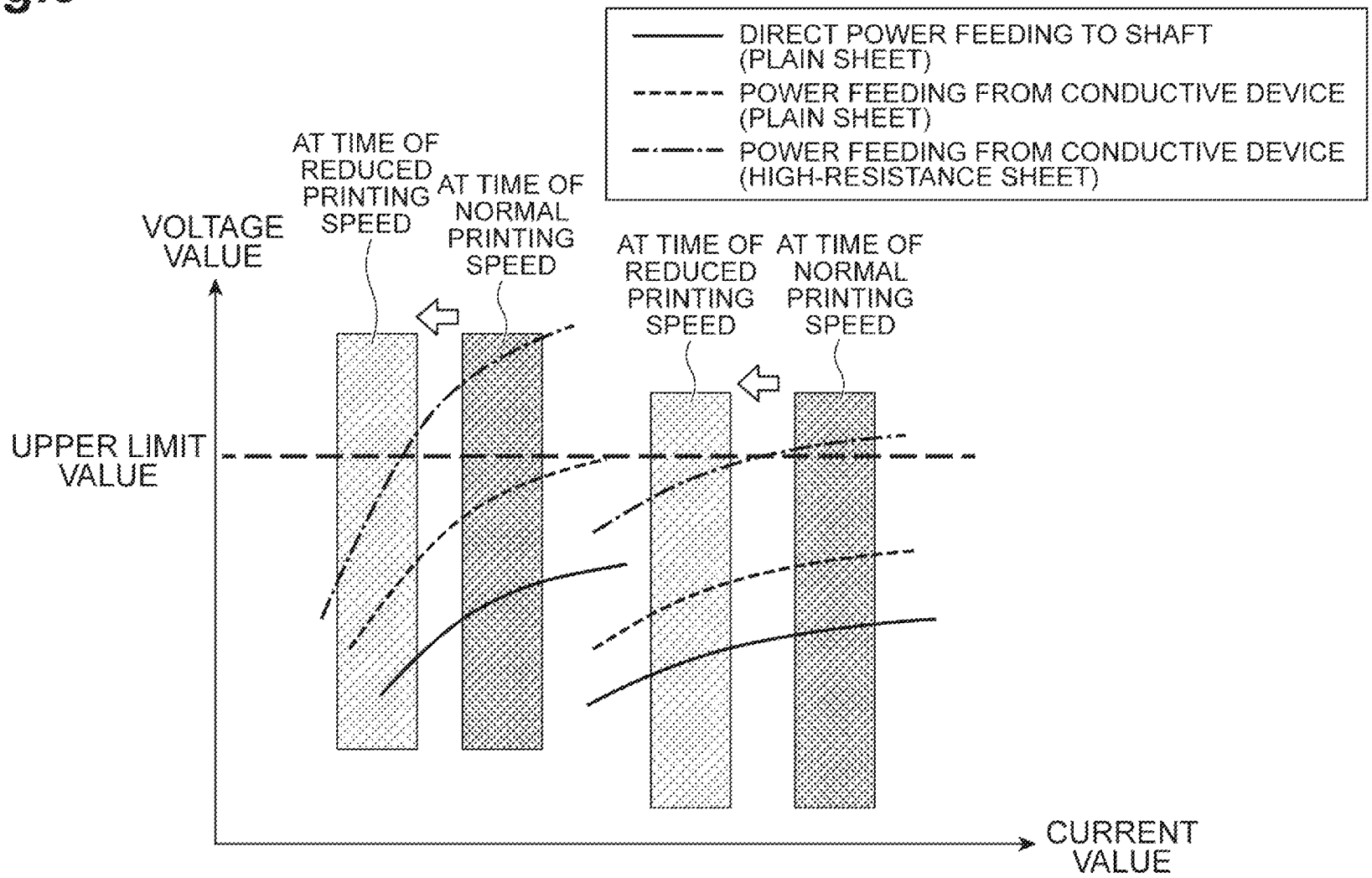
FIG. 9 is a graph illustrating relationships of a current value and a voltage value with respect to the transfer roller for different types of print medium and different power supply paths to the transfer roller.

The transfer of the toner image onto the print medium P can be achieved with a certain amount of current. However, with reference to FIGS. 8 and 9, in the case of supplying power to the transfer roller 34 externally or indirectly (e.g., from the outside via the conductive device 35) of the transfer roller 34, as compared with the case of supplying power directly to the shaft 34*b*, an electrical resistance R (system resistance) of the system including the transfer roller 34 and the transfer belt 31 is increased, which increases the output voltage corresponding to the necessary current.

In addition, the output voltage is associated with an upper limit value, and even when supplying the power to the transfer roller 34 from the conductive device 35, the output voltage when the print medium P is a plain sheet, most often does not exceed the upper limit value. However, the electrical resistance of the print medium P may vary depending on the type of the print medium P, and when the printing speed is normal and the print medium P is a high-resistance sheet such as a thick sheet or a special sheet, the output voltage may exceed the upper limit value when supplying power to the transfer roller 34 from the conductive device 35. When the output voltage exceeds the upper limit value, a transfer failure may occur.

In the example imaging apparatus 1, the resistance measurement device 37 measures the electrical resistance of the print medium P, and the controller 38 reduces the printing speed based on the electrical resistance of the print medium P measured by the resistance measurement device 37. Therefore, even in a case where the print medium P is a high-resistance sheet and the power to the transfer roller 34 is supplied from the conductive device 35, the amount of current for achieving the transfer of the toner image, can be reduced by decelerating the printing speed, as illustrated in the two examples of FIG. 9. Accordingly, the output voltage is inhibited from exceeding the upper limit value, to reduce the risk of a transfer failure.

The controller 38 may reduce the printing speed when the electrical resistance measured by the resistance measurement device 37 is equal to or greater than the threshold resistance value. For example, when the electrical resistance of the print medium P is equal to or greater than a predetermined threshold resistance value, the printing speed is reduced, so that the printing speed can be switched stepwise (e.g., to modify the printing speed stepwise) depending on whether or not the electrical resistance is equal to or greater than the threshold resistance value.

With reference to FIG. 4, the power source 36 may include the first supply path 36*b* which is electrically connected to the conductive device 35 to supply the first bias B1 to the transfer roller 34 through the conductive device 35 and the second supply path 36*c* which is electrically connected to the shaft 34*b* of the transfer roller 34 to directly supply the second bias B2 to the shaft 34*b* of the transfer roller 34, to suppress or inhibit the increase in the electrical resistance of the transfer roller 34 by supplying the first bias B1 to the transfer roller 34 via the conductive device 35 through the first supply path 36*b* during the normal printing operation, and to directly supply the second bias B2 to the shaft 34*b* through the second supply path 36*c* when an abnormality occurs.

As described above, the resistance measurement device 37 may include the system resistance measurement device 37*b* for measuring the electrical resistance of the first nip portion N1 formed between the transfer roller 34 and the transfer belt 31. Accordingly, the electrical resistance may be measured with a relatively simple structure.

In some examples, the resistance measurement device 37 may also include the resistance detection sensor 37*c* arranged in or adjacent the registration rollers 12 (FIG. 5), the resistance detection sensor 37*d* arranged in or adjacent the pick-up roller 11, and the resistance detection sensor 37*f* arranged in the tray T Accordingly, the measurement locations for measuring the electrical resistance of the print medium P, may be conveniently set at the registration rollers 12, the pick-up roller 11, and the tray T for a relatively simple design.

The shaft 34*b* of the transfer roller 34 is a metal shaft which is electrically floated during the printing operation, the conductive device 35 may have an electrical resistance lower than that of the transfer roller 34. In addition, the conductive device 35 may be a conductive roller. Accordingly, the configuration of the conductive device 35 may be simplified.

As illustrated in FIG. 3, the straight line L connecting the first nip portion N1 and the second nip portion N2 may pass through (intersect) the shaft 34*b* of the transfer roller 34, in order to more reliably form the first path 34*f* of the bias voltage directed from the surface 34*d* toward the shaft 34*b* and the second path 34*g* of the bias voltage directed from the shaft 34*b* toward the surface 34*d*.

Figure 10:
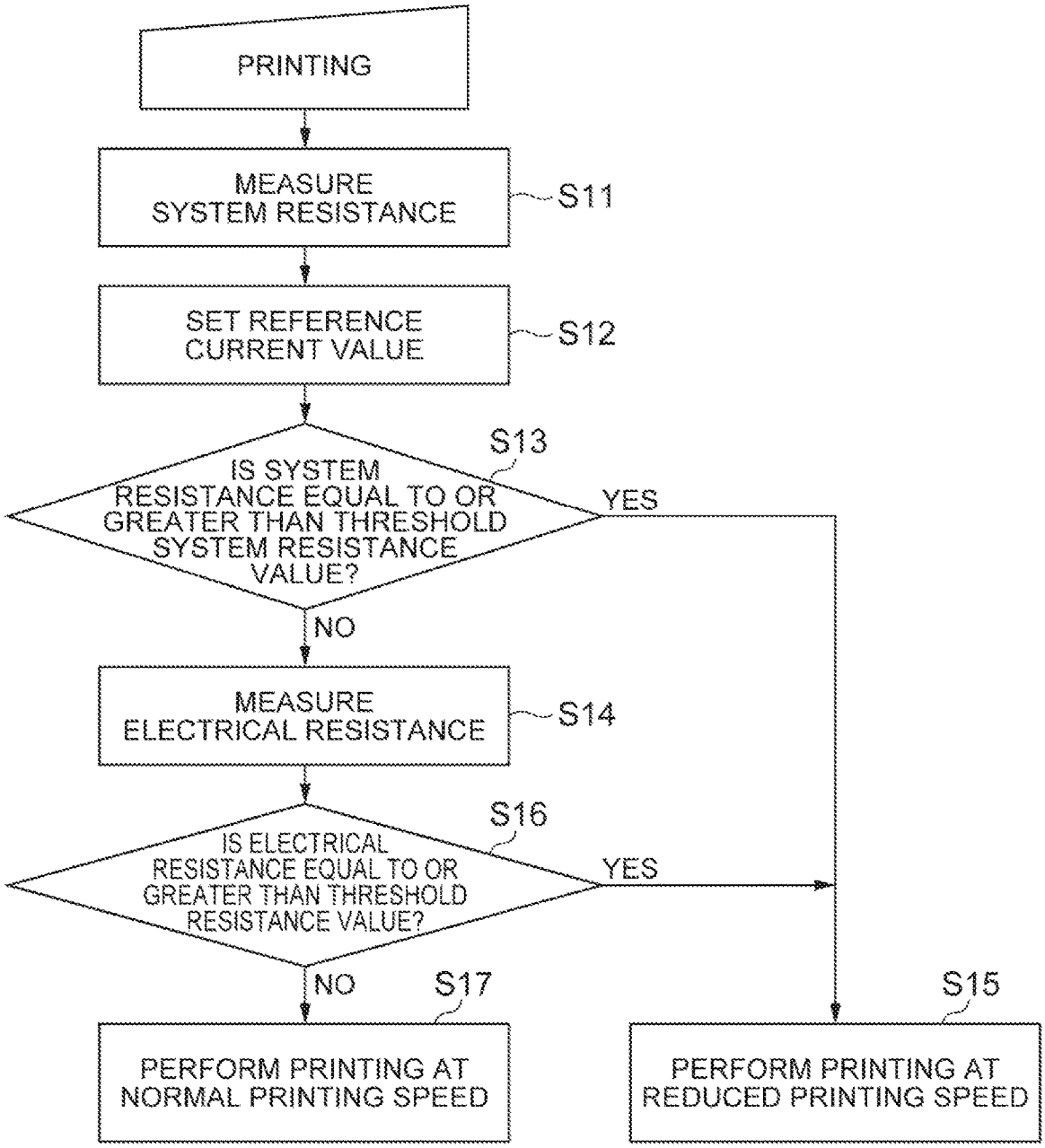
FIG. 10 is a flowchart of an example process to adjust a printing speed of an imaging system.

An example of operations of the transfer unit (or device) 30 during the printing operation of the imaging apparatus 1 according to a modified example will be described. With reference to FIG. 10, when the print signal is input to the imaging apparatus 1, the system resistance of the transfer roller 34 is measured (at operation S11), and the reference current value to be supplied to the transfer roller 34 is set (at operation S12), similarly to the example process illustrated in FIG. 6.

At operation S13, the controller 38 determines whether or not the measured system resistance is equal to or greater than a threshold system resistance value. The threshold system resistance value is a reference value for determining whether or not the measured system resistance is a value that affects the printing operation of the imaging apparatus 1, and the threshold system resistance value may be set as appropriate. When the controller 38 determines that the system resistance is less than the threshold system resistance value (e.g., not equal to or greater than the threshold system resistance value), the process proceeds to operation S14. When the controller 38 determines that the system resistance is equal to or greater than the threshold system resistance value, the process proceeds to operation S15 to reduce the printing speed.

The processes of operations S14, S16, and S17 may be similar to the respective processes of operations S3, S4, and S5, respectively, of the example illustrated in FIG. 6. For example, at operation S14, the resistance measurement device 37 measures the electrical resistance of the print medium P, and at operation S16, the controller 38 determines whether or not the electrical resistance of the print medium P is equal to or greater than the threshold resistance value. When the electrical resistance of the print medium P is determined as less than the threshold resistance value (e.g., as not equal to or greater than the threshold resistance value), the printing continues to be performed at a normal printing speed (operation S17), and when the electrical resistance of the print medium P is determined as equal to or greater than the threshold resistance value, the printing speed is reduced (operation S15).

In the modified example, before the resistance measurement device 37 measures the electrical resistance of the print medium P, the controller 38 determines the system resistance. Where the system resistance is equal to or greater than the threshold system resistance value, the controller 38 reduces the printing speed, and in a case where the system resistance is less than the threshold system resistance value (e.g, not equal to or greater than the threshold system resistance value), the resistance measurement device 37 measures the electrical resistance of the print medium P. In this case, by measuring the system resistance before measuring the electrical resistance of the print medium P, the controller 38 determines whether or not to reduce the printing speed in consideration of both the system resistance and the electrical resistance of the print medium P. Accordingly, the printing speed may be controlled with better accuracy, according to the system resistance and the electrical resistance of the print medium P.

Figure 11:
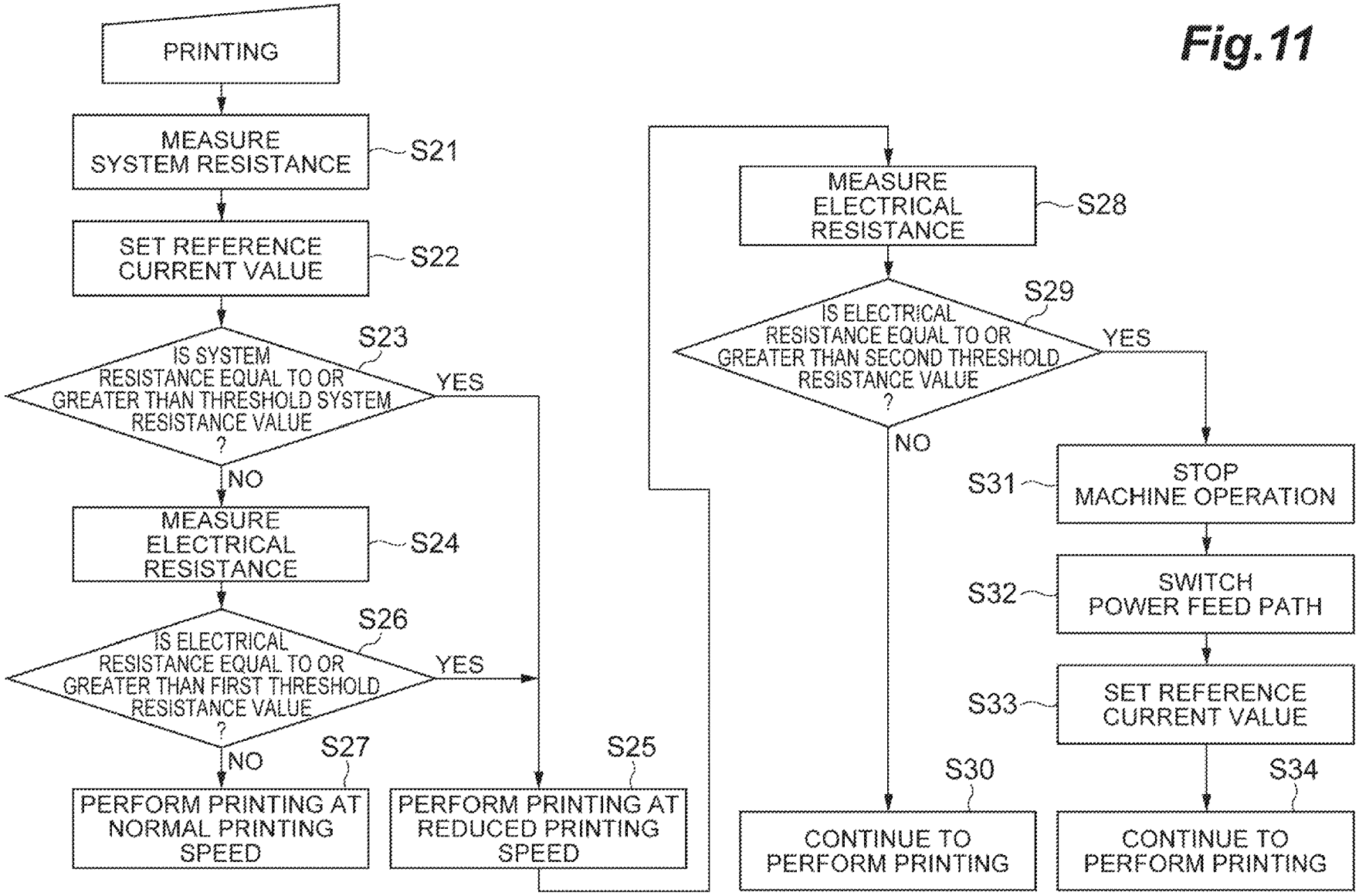
FIG. 11 is a flowchart of an example process to adjust a printing speed of an imaging system.

With reference to FIG. 11, another modified example process carried out by the transfer unit (or device) 30 during the printing operation of the imaging apparatus 1 will be described. The operations S21 to S27 of FIG. 11 may be carried out similarly to the operations S11 to S17, respectively, of FIG. 10. In addition, at operation S26, the controller 38 determines whether or not the electrical resistance of the print medium P is equal to or greater than the first threshold resistance value. Where the electrical resistance of the print medium P is less than the first threshold resistance value (e.g., not equal to or greater than the first threshold resistance value), the printing continues to be performed at a normal printing speed. Where the electrical resistance of the print medium P is equal to or greater than the first threshold resistance value, the controller 38 reduces the printing speed.

At operation S28, the resistance measurement device 37 further measures the electrical resistance of the print medium P. At operation S29, the controller 38 determines whether or not the electrical resistance of the print medium P is equal to or greater than the second threshold resistance value. The value of the second threshold resistance value may be different from the value of the first threshold resistance value according to some examples, or the value may be the same as the value of the first threshold resistance value according to other examples.

At operation S30, in a case where it is determined by the controller 38 that the electrical resistance of the print medium P is less than the second threshold resistance value (e.g. not equal to or greater than the second threshold resistance value), the printing continues to be performed at a reduced printing speed. In a case where it is determined by the controller 38 that the electrical resistance of the print medium P is equal to or greater than the second threshold resistance value, the operation (e.g., machine operation or system operation) of the imaging apparatus 1 is stopped at operation S31, and the power feed path from the power source 36 to the transfer roller 34 is switched from the first supply path 36*b* to the second supply path 36*c* at operation S32.

At this time, the controller 38 may control the contact separation mechanism 39 to separate (e.g., to space apart) the conductive device 35 from the transfer roller 34 and may switch the supply path of the bias to the transfer roller 34 from the first supply path 36*b* to the second supply path 36*c*. That is, the supply of the bias to the transfer roller 34 is performed by the direct supply of the second bias B2 from the power source 36 to the shaft 34*b*. At operation S33, the controller 38 sets the reference current value of the current to be supplied to the transfer roller 34 and at operation S34, the controller 38 controls the printing to continue at a reduced printing speed.

With reference to the modified example illustrated in FIG. 11, the controller 38 may supply the first bias B1 to the transfer roller 34 from the power source 36 through the first supply path 36*b*, reduce the printing speed when the electrical resistance measured by the resistance measurement device 37 is equal to or greater than the first threshold resistance value, and switch the supply path of the bias to the transfer roller 34 from the first supply path 36*b* to the second supply path 36*c* when the electrical resistance measured by the resistance measurement device 37 after the reduction of the printing speed, is equal to or greater than the second threshold resistance value.

In this case, when the electrical resistance of the print medium P is no less than the second threshold resistance value even by reducing the printing speed, it is possible to directly supply the second bias B2 to the shaft 34*b*. Accordingly, since the system resistance (electrical resistance R) of the system including the transfer roller 34 and the transfer belt 31 can be physically reduced, it is possible to more reliably avoid or inhibit a transfer failure by switching the supply path of the bias in a manner of emergency escape.

In addition, the conductive device 35 may be configured to be separable from the transfer roller 34. When the conductive device 35 is in contact with the transfer roller 34, the first bias B1 may be supplied to the conductive device 35 through the first supply path 36*b*, and when the conductive device 35 is separated from the transfer roller 34, the second bias B2 may be supplied to the transfer roller 34 through the second supply path 36*c*.

Accordingly, the formation of a recess in the surface 34*d* of the transfer roller 34 may be prevented or inhibited by spacing apart the conductive device 35 from the transfer roller 34. The power supply to the transfer roller 34 through the first supply path 36*b* (conductive device 35) may be performed during the normal printing operation, and the direct power supply to the transfer roller 34 where the conductive device 35 spaced away may be performed as an emergency measure when the electrical resistance is high. Accordingly, the path of the power supply to the transfer roller 34 during the normal printing operation and at the time of emergency can be clearly distinguished, to improve the reliability of the supply of the bias voltage.

Figure 12:
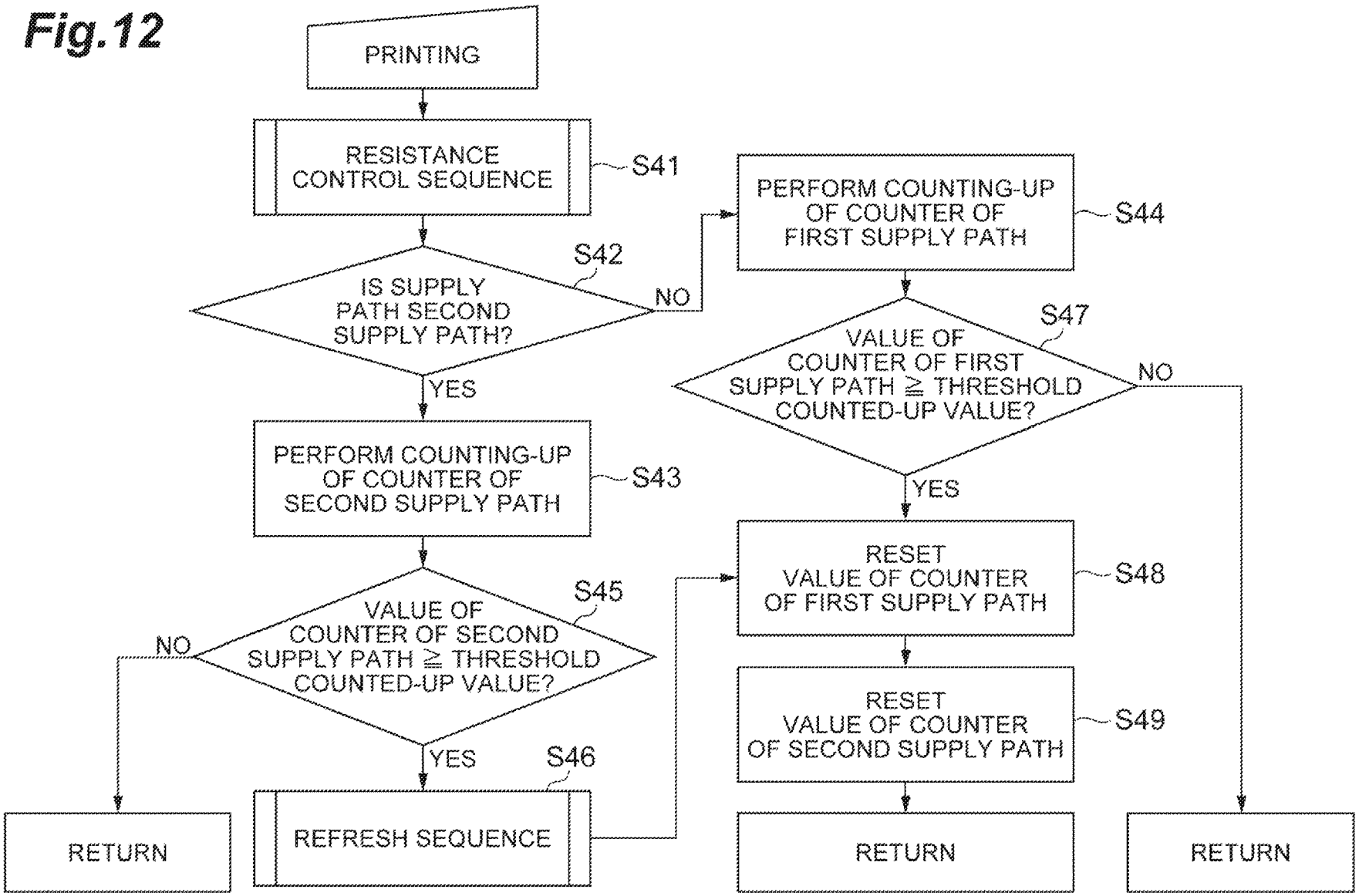
FIG. 12 is a flowchart of an example process of switching a supply path of a bias to the transfer roller.

With reference to FIG. 12, a modified example of the path switching of the first supply path 36*b* and the second supply path 36*c* will be described. At operation S41, the "resistance control sequence" may include a series of processes relating to the controlling of the printing speed and the switching of the supply path of the bias similarly to operations S21 to S34 or the like, of the example illustrated in FIG. 11.

At operation S42, the controller 38 determines whether or not the supply path of the bias to the transfer roller 34 is the second supply path 36*c*. At operation S43, in a case where it is determined that the supply path of the bias to the transfer roller 34 is the second supply path 36*c*, the controller 38 increments (counting-up of) the value of the counter of the second supply path 36*c* at regular time intervals (where the time intervals are set to a certain period of time). At operation S44, where it is determined that the supply path of the bias to the transfer roller 34 is not the second supply path 36*c* but rather the first supply path 36*b*, the controller 38 increments (counting-up of) the value of the counter of the first supply path 36*b* at regular time intervals (set to a certain period of time).

At operation S43, the counter associated with the second supply path 36*c* is incremented at regular time intervals, and when the value of the counter (e.g., a counter value or count value) of the second supply path 36*c* is not equal to or greater than a threshold count value (e.g., a threshold counted-up value) (NO at operation S45), the process is ended. When the value of the counter of the second supply path 36*c* is equal to or greater than the threshold count (threshold counted-up value), that is, when a predetermined time has elapsed with the supply path being switched to the second supply path 36*c*, a refresh sequence is performed at operation S46.

In the refresh sequence, the electrical resistance is forcibly reduced, for example, by supplying a bias in the opposite direction from the drive roller 32*d* to the transfer roller 34. At operation S48, the value of the counter of the first supply path 36*b* is reset, and at operation S49, the value of the counter of the second supply path 36*c* is reset, and the process is ended.

At operation S44, the incrementing of the first supply path 36*b* is performed at regular time intervals (set to a certain period of time), and when the value of the counter of the first supply path 36*b* is less than the threshold count value (e.g., not equal to or greater than the threshold counted-up value) (NO at operation S47), the process is ended. When the value of the counter of the first supply path 36*b* is equal to or greater than the threshold count (threshold counted-up value), that is, when a predetermined time has elapsed by using the first supply path 36*b* as a supply path of the bias, the value of the counter of the first supply path 36*b* is reset at operation S48, and the value of the counter of the second supply path 36*c* is reset at operation S49, and the process is ended.

In order to switch between the first supply path 36*b* and the second supply path 36*c*, the controller 38 increments the value (performs the counting-up of the value) at regular time intervals after switching the supply path of the bias to the transfer roller 34, to the second supply path 36*c*, and when the incremented value (counted-up value) is equal to or greater than the threshold count (threshold counted-up value), a refresh sequence for supplying the bias to the transfer roller 34 from the drive roller 32*d* may be performed.

When the electrical resistance is not decreased even by directly supplying the second bias B2 to the shaft 34*b* by using the second supply path 36*c*, it is possible to more effectively reduce the system resistance of the system including the transfer roller 34 and the transfer belt 31 by supplying a bias in the opposite direction from the drive roller 32*d* to the transfer roller 34. Accordingly, the occurrence transfer failure by changing the supply path of the bias in a manner of emergency escape may be reduced more reliably.

It is to be understood that not all aspects, advantages and features described herein may necessarily be achieved by, or included in, any one particular example. Indeed, having described and illustrated various examples herein, it should be apparent that other examples may be modified in arrangement and detail is omitted. For example, the transfer roller may be a primary transfer roller, and the imaging apparatus may be an imaging system for forming a monochrome image.

The invention claimed is:

1. An imaging system comprising:

a transfer roller having a surface to transfer a toner image onto a print medium during a printing operation of the imaging system, the transfer roller to rotate according to a printing speed of the printing operation;

a conductive device to contact the surface of the transfer roller;

a power source electrically connected to the conductive device, the power source to supply a bias to the transfer roller through the conductive device during the printing operation, wherein the power source comprises:

a first supply path electrically connected to the conductive device, the first supply path to supply the bias to the transfer roller through the conductive device, and a second supply path electrically connected to a shaft of the transfer roller, the second supply path to directly supply the bias to the shaft of the transfer roller;

a resistance measurement device to measure an electrical resistance of the print medium; and a controller to reduce the printing speed based on the electrical resistance measured by the resistance measurement device.

2. The imaging system of claim 1, the controller to reduce the printing speed in response to the electrical resistance being equal to or greater than a threshold resistance value.

3. The imaging system of claim 1, wherein the power source is to supply the bias through the conductive device to the shaft of the transfer roller from a portion of the surface of the transfer roller that is in contact with the conductive device.

4. The imaging system of claim 1, wherein the conductive device comprises a conductive roller.

5. The imaging system of claim 1, the controller to supply the bias to the transfer roller through the first supply path from the power source and to reduce the printing speed, in response to the electrical resistance measured by the resistance measurement device being equal to or greater than a first threshold resistance value, and the controller to switch a supply path of the bias from the first supply path to the second supply path in response to the electrical resistance measured by the resistance measurement device, after reducing the printing speed, being equal to or greater than a second threshold resistance value.

6. The imaging system of claim 1, comprising a backup roller located on an opposite side of the transfer roller when viewed from the print medium, the controller to increment a count value after switching the supply path of the bias to the second supply path after a period of time has elapsed, and the controller to perform a refresh sequence to supplying the bias to the transfer roller from the backup roller in response to the count value being equal to or greater than a threshold count value.

7. The imaging system of claim 1, comprising a transfer belt facing the transfer roller, wherein a nip portion is formed between the transfer roller and the transfer belt to accommodate a passage of the print medium through the nip portion, wherein the resistance measurement device includes a system resistance measurement device to measure an electrical resistance of the nip portion between the transfer roller and the transfer belt.

8. The imaging system of claim 1, comprising registration rollers located at an upstream side of the transfer roller in a transporting path of the print medium, wherein the resistance measurement device includes a resistance detection sensor coupled to the registration rollers.

9. The imaging system of claim 1, comprising a pick-up roller located upstream of the transfer roller in a transporting path of the print medium, the pick-up roller to pick up the print medium stored in a tray, wherein the resistance measurement device includes a resistance detection sensor coupled with to the pick-up roller.

10. The imaging system of claim 1, comprising a tray to store the print medium to be supplied to the transfer roller, wherein the resistance measurement device includes a resistance detection sensor arranged in the tray.

11. The imaging system of claim 1, comprising a transfer belt located adjacent the transfer roller to form a first nip portion between the transfer roller and the transfer belt, wherein the conductive device forms a second nip portion between the conductive device and the transfer roller, and wherein a line connecting the first nip portion and the second nip portion intersects the shaft of the transfer roller.

12. The imaging system of claim 1, wherein the shaft of the transfer roller is a metal shaft electrically floated during the printing operation, and the conductive device has an electrical resistance lower than an electrical resistance of the transfer roller.

13. An imaging system comprising:

a transfer roller having a surface to transfer a toner image onto a print medium during a printing operation of the imaging system, the transfer roller to rotate according to a printing speed of the printing operation;

a conductive device to contact the surface of the transfer roller, wherein the conductive device is a conductive roller that is operable to be spaced apart from the transfer roller;

a power source electrically connected to the conductive device, the power source to supply a bias to the transfer roller through the conductive device during the printing operation;

a resistance measurement device to measure an electrical resistance of the print medium; and a controller to reduce the printing speed based on the electrical resistance measured by the resistance measurement device.

14. The imaging system of claim 13, wherein the power source includes a first supply path electrically connected to the conductive device, the first supply path to supply the bias to the transfer roller through the conductive device, and a second supply path electrically connected to a shaft of the transfer roller, the second supply path to directly supply the bias to the shaft of the transfer roller, the power source to supply the bias to the conductive device through the first supply path in response to the conductive device being in contact with the transfer roller, and the power source to supply the bias to the transfer roller through the second supply path in response to the conductive device being spaced apart from the transfer roller.

15. The imaging system of claim 13, wherein the controller is to control a separation of the conductive device from the transfer roller.

16. The imaging system of claim 13, wherein the transfer roller includes a metal shaft electrically floated during the printing operation, and the conductive device has an electrical resistance lower than an electrical resistance of the transfer roller.

17. The imaging system of claim 13, wherein the conductive device comprises a conductive roller.

18. An imaging system comprising:

a transfer roller having a surface to transfer a toner image onto a print medium during a printing operation of the imaging system, the transfer roller to rotate according to a printing speed of the printing operation, wherein the transfer roller includes a metal shaft electrically floated during the printing operation;

a conductive device to contact the surface of the transfer roller, wherein the conductive device has an electrical resistance lower than an electrical resistance of the transfer roller;

a power source electrically connected to the conductive device, the power source to supply a bias to the transfer roller through the conductive device during the printing operation;

a resistance measurement device to measure an electrical resistance of the print medium; and a controller to reduce the printing speed based on the electrical resistance measured by the resistance measurement device.

19. A non-transitory machine-readable storage medium comprising instructions executable by a controller for an imaging system that includes a transfer roller to rotate according to a printing speed to transfer a toner image onto a print medium during a printing operation of the imaging system, and a conductive device to supply a bias to the transfer roller during the printing operation via a surface of the transfer roller, wherein the instructions upon execution cause the controller to:

receive an electrical resistance of the print medium;

determine that the print medium is a high resistance print medium based on detecting that the electrical resistance of the print medium is equal to or greater than a threshold resistance; and reduce the printing speed of the printing operation, in response to detecting that the electrical resistance of the print medium is equal to or greater than the threshold resistance.

20. The non-transitory machine-readable storage medium of claim 19, wherein the instructions upon execution cause the controller to:

control a separation of the conductive device from the transfer roller such that the conductive device and the transfer roller are spaced apart.

* * * * *